United States Patent [19]

Byers et al.

[11] Patent Number: 5,046,222

[45] Date of Patent: Sep. 10, 1991

[54] CLASP DEVICE FOR FABRICS, FILMS AND SHEET MATERIALS

[75] Inventors: Timothy W. Byers; Gary L. Byers, both of Whitefish, Mont.

[73] Assignee: Creative Sales & Mfg. Co., Inc., Whitefish, Mont.

[21] Appl. No.: 804,812

[22] Filed: Oct. 26, 1990

[51] Int. Cl.[5] ..... A44B 21/00

[52] U.S. Cl. ..... 24/343; 24/357

[58] Field of Search ..... 24/90 C, 90 A, 92, 90 E, 24/459, 343

[56] References Cited

U.S. PATENT DOCUMENTS

| | | | |
|---|---|---|---|
| 697,808 | 4/1902 | Chauvet | 24/459 |
| 1,056,020 | 3/1913 | Graham | 24/90 C |
| 1,399,730 | 12/1921 | Abe | 24/90 C |
| 2,435,082 | 1/1948 | Huber | 24/459 |
| 4,175,305 | 11/1979 | Gillis | 24/459 |
| 4,660,240 | 4/1987 | Hutton et al. | 24/459 X |

FOREIGN PATENT DOCUMENTS

| | | | |
|---|---|---|---|
| 132500 | 7/1951 | Sweden | 24/459 |
| 189038 | 4/1964 | Sweden | 24/459 |

*Primary Examiner*—James R. Brittain

*Attorney, Agent, or Firm*—George M. Cole

[57] ABSTRACT

A quick release and snap-together clasp device (10) having a one-piece body frame which includes a main opening (16) for receiving and coacting with a releasable button member (50), the opening (16) also including inwardly extending projections (34,36) for defining a button engaging area. The body is rounded at the bottom (14) to accommodate a round button member (50) having a peripheral groove (60) to be received in the body for holding sheet and film materials. The body also includes an additional opening (40) and a hook (48).

5 Claims, 2 Drawing Sheets

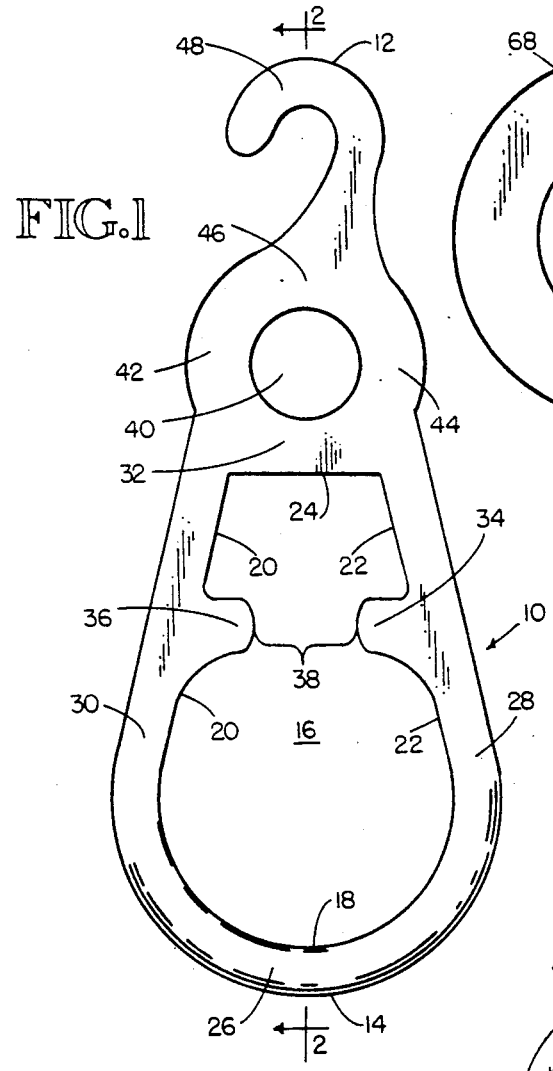
FIG. 1
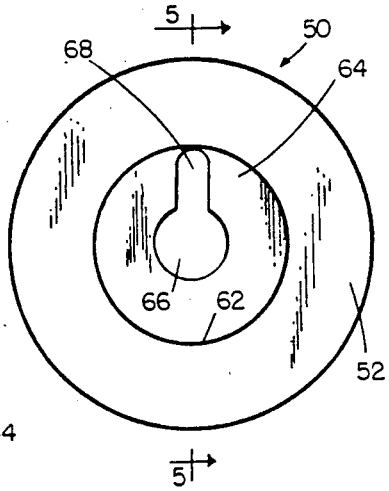
FIG. 3
FIG. 4
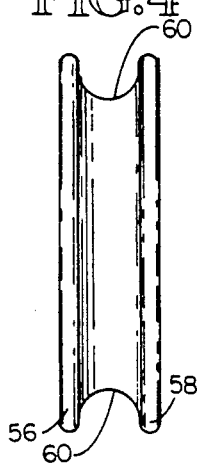
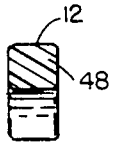
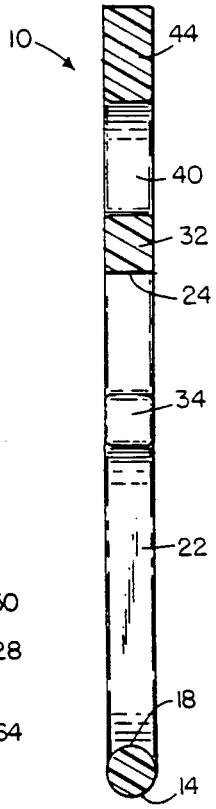
FIG. 2
FIG. 6
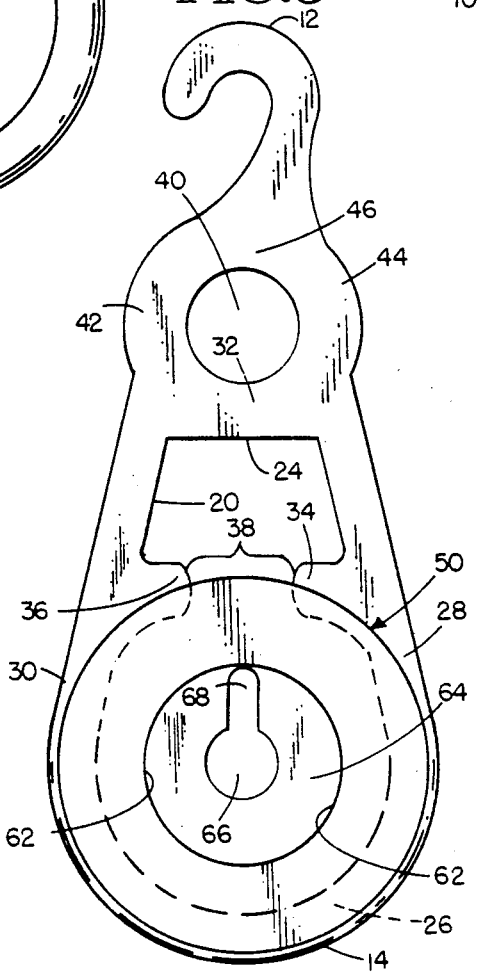
FIG. 5
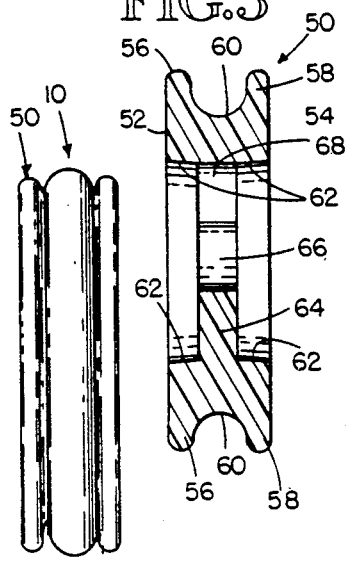
FIG. 7

CLASP DEVICE FOR FABRICS, FILMS AND SHEET MATERIALS

TECHNICAL FIELD

The invention relates to the field of flexible sheet and fabric clasps and more particularly to an improved clasp for holding grasping and holding a variety of sheet-like materials.

BACKGROUND ART

As those skilled in the art are aware, it frequently is necessary or desirable to securely hold a sheet of plastic, canvas, waterproof tarpaulin or sheet of fabric in a particular location. Instances of use might be covering a woodpile or a load of furniture in the back of an open pickup truck. Inevitably a problem arises as to how the sheet or film is to be held in place without blowing off or being dislodged. A related problem is securing the sheet or flexible material without spending an undue amount of time. Thus, there has been recognized a need for a clasp device which is reliable and can be depended upon to hold the sheet material securely. Additionally, a need has been recognized for versatility in such a device in that it must be capable of being quickly attached and detached and that wind, vibration or the slick surface of the material will not not cause it to work loose.

Numerous clasp type devices have been designed and most are patterned after or are similar to an old fashioned garter belt snap for holding women's hose.

Different embodiments of clasp devices are found in the following domestic and foreign patents. They are: U.S. Pat. Nos. 4,660,240; 4,308,647; 4,175,305; 3,537,155; 3,530,550; 2,920,368; 3,177,550; 2,498,154; 2,435,082; 2,300,342; 1,399,730; 897,811; 567,195; 678,654; 697,808; 696,626; Swedish Pat. Nos. 132,500 and 189,038; and German Pat. No. 0422760.

Of particular interest to the disclosure and claims of this application and invention are the two Swedish patents listed above. No. 132,500 shows elastic, plastic body 1 with inward extensions 7*a*, 7*b* and 8. Member 2 is held in place by the inward extendions engaging end slots 10 and 11. A towel or other fabric item or other sheet material is held in place by tucking a corner of the fabric item through opening 5 and then inserting member 2 in place to hold the cloth item securely in place. The manner of use of the device and its precise configuration are significantly different from the clasp of this application which is formed to accomodate a round button member as opposed to the irregularly shaped opening 5 and member 2 in the Swedish patent.

Swedish disclosure 189,038 is similar to the instnat device insofar as it includes inwardly extending member 7,7*a* to coact with button member 5 shown in FIGS. 4–6. It will be noted that this reference shows button 5 with one small edge flange 10 and one larger edge flange 9 of larger diameter. The body of this device receives the tarpaulin which is secured in place by button 5. However, the T-shaped internal tongue member 7, 7*a* and the unsymmetrical structure of the button are different enough so that the device does not anticipate the particular clasp of the instant invention.

SUMMARY OF THE INVENTION

The invention is comprised of two pieces, a plastic body which amounts to a frame and a round, coacting detachable button member. The body includes an elongated main opening which has a large arcuate end and a narrower, roughly rectangular end. A pair of opposing lugs or projections extend inwardly a short distance within the main opening to define a button cavity in which the button member is received and retained. A smaller rectangular cavity is located at the top end of the main opening on the other side of the lug projections. The body is further provided with a small round opening in spaced relation to the rectangular end of the main opening. Finally, a hook is provided at the upper end of the body. The button member is provided with a central hole and coacting key slot. Thus, a sheet material is held by engaging the body and button together with the sheet between them so that a pocket of the sheet material is formed around the button.

Accordingly it is among the many features of the invention to provide a snap-on clasp for use with items such as fabrics, sheet plastics, film materials and the like for holding the same securely. The snap-on clasp is simple in design, inexpensive and rugged so that it can function with light plastic film and/or heavy waterproof tarpaulin and canvas materials. The device holds the sheet material securely without losing its grip because of wind, vibration or slick oily surfaces on the material being secured. The invention is versatile in that it will hold fabric and sheet material of all types and sizes. The button member may be temporarily or permanently secured in position and the body engaged to hold the sheet material or the body may be secured and the button member used to engage the sheet material. The device may be used as a hanger for towels and other fabric materials as a more dependable holder than a common closet hanger. The button member and body are resilient enough so that they can be flexed around a sheet material but yet are strong enough so that they do not easily pull loose by sharp tugs on the sheet or slip free.

BRIEF DESCRIPTION OF THE DRAWINGS

FIG. 1 is a face view of the body member's configuration showing details of its shape;

FIG. 2 is a cross-sectional view of the body taken along the line 2—2 of FIG. 1 showing additional details of its construction;

FIG. 3 is a face view of the button member;

FIG. 4 is an edge view of the button member;

FIG. 5 is a transverse sectional view of the button member taken along the line 5—5 of FIG. 3;

FIG. 6 is a face view of the two pieces engages;

FIG. 7 is an edge view from the bottom end of the body showing button member and body engaged;

BEST MODE FOR CARRYING OUT THE INVENTION

Figure 8:
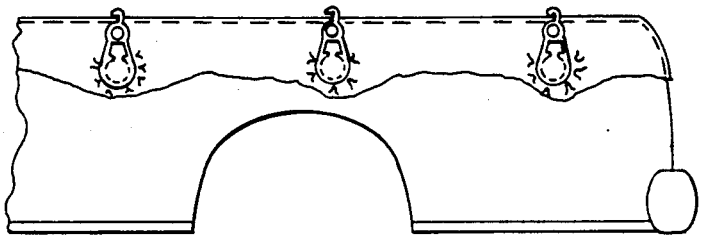
FIG. 8 is a partial illustrative view showing use of the invention on the bed of a pickup truck.

Referring now to the drawings, particularly FIGS. 1–7, it will be seen that the body member generally designated by the number 10 is a generally flat, flexible plastic member having an upper or hook end 12 and a rounded lower end 14. Body 10 tapers from the lower rounded end to its upper hook end and as can be seen includes a main opening 16 having a rounded lower inside edge 18, inside generally straight edges 20 and 22 and a top cross surface 24. Note that the body between inside and outside surfaces has a transverse thickness of about a quarter inch, though that dimension may vary according to design preferences. Thus, the inside and outside surfaces define body lower frame section 26 and side frame sections 28 and 30, and upper frame section 32.

Within main opening 16 and located on each side of the inside surfaces 20,24 of the opening are opposed inwardly extending lugs or rounded projections 34 and 36. The projections 34 and 36 extend inwardly towards each other a short distance and leaving gap 38 between them. Above frame section 32 is a second opening 40 bounded by generally circular frame portions 42 and 44 which come together as at 46 and above which is formed hook 48. In total the length of body 10 from end 12 to end 14 is about 4½ inches though this dimension may vary as desired. It will be noted that the projections 34, 36 ar located so that opening 16 is slightly elongated and thus not perfectly circular so that the coacting button member now to be described is provided with some looseness of fit when joined with the body.

The button member, generally designated by the number 50, is a round body having face surfaces 52,54 and is shaped like a pulley having annular walls 56,58 and an annular groove 60. The center portion of the button has a reduced thickness formed by inwardly offset surfaces 62 so that said center portion is substantially thinner and comprises a hub section 64 of predetermined thickness. A central hole 66 together with a radial slot 68 defines a keyhole shaped opening in the hub section 64. The slot 68 extends approximately to offset surfaces 62 and is proportioned such that the head, for instance, of a sixteen penny nail will slip through opening 66 and such that the slot 68 receives the nail shank. In this way the button member can be securely fastened such as by a screw or bolt or it may be quickly detachable depending on the use to which the clasp is put.

Figure 9:
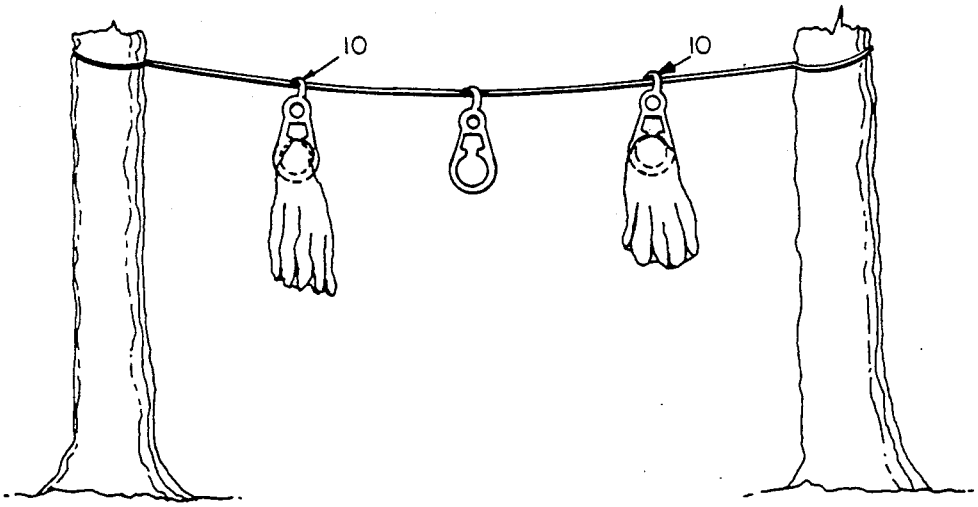
FIG. 9 shows another use of the device for camping.
Figure 10:
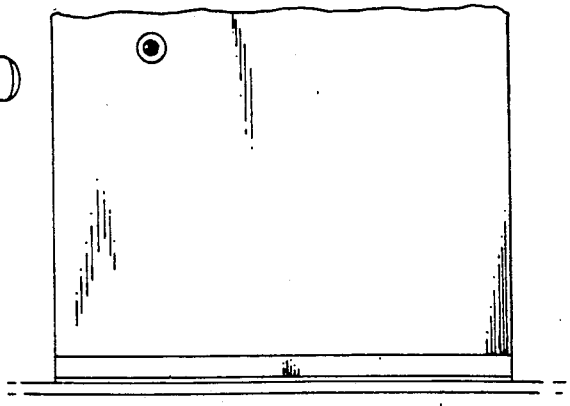
FIG. 10 shows that the button member may be removably or semi-permanently secured to a wall.

FIGS. 8–10 illustrate the different ways in which the clasp of this invention may be utilized. For instance, FIG. 8 shows that a plurality of button members 50 can be semi-permanently secured by bolts or metal screws to the outside of a pickup truck bed at desired intervals. When it is desired to secure a sheet of protective material over the bed it is only necessary to engage a body member 10 with each of the button members to secure a reliable grip. Thus it is not necessary to use ropes which if the cover is only a plain sheet material can be extremely awkward and which can blow loose from the force of wind. Additionally, if the cover does have grommeted openings around the edge the hook portion may be used to engage the grommets in which case it may be desirable to use a stretchable bungie rope.

FIG. 9 shows that the invention may also be used to hold towels or other items of sheet material or fabric to hang on a line. If there is a threat that the clasp could be lifted off the rope then the rope could be inserted through the closed opening 40 below the hook and the clasp secured in that manner. Finally, FIG. 10 shows that the buttons may be mounted on a structure such as a wall, as for instance by bolt or nail, and a towel or other item held by engaging the body with the button.

We claim:

1. A clasp device for holding and securing flexible sheet-like materials, comprising:

(a) a one piece body member constituting a frame of predetermined length, width and thickness and being made of a predetermined resiliency for limited flexing and having an upper end and a lower end and further having an elongated main opening in said body defined by integrally joined bottom, side and top frame sections, said main opening having a pair of spaced apart projections extending inwardly from said side frame section to define a button member engaging area to coact with said body for holding sheet material and the like, said body also including a closed second opening above said top frame section and also including a hook means at the upper end thereof, and (b) a coacting shallow, cylindrically shaped button member having peripheral annular side walls and a peripheral annular grove between said side walls, said button member also having a central hub section including a key slot opening therethrough so that said button member can be secured to another structure if desired, whereby said button member and said body may be engaged with each other to hold sheet materials and the like.

2. The clasp device according to claim 1 and wherein said bottom frame section of said body is generally rounded so that it together with said projections engages the peripheral groove of said button member to hold said body member and button member together.

3. The clasp device according to claim 2 and wherein said button member has a central hub section of reduced thickness and in which said key slot opening is located.

4. The clasp device according to claim 1 and wherein said button member has a central hub section of reduced thickness and in which said key slot opening is located.

5. The clasp device according to claim 1 and wherein said key slot opening comprises a round central opening and a radially disposed slot extending outwardly from said round central opening a predetermined distance.

* * * * *